US010016042B2

(12) United States Patent
Adams et al.

(10) Patent No.: US 10,016,042 B2
(45) Date of Patent: Jul. 10, 2018

(54) HEATING DEVICE

(71) Applicant: Reckitt Benckiser (Brands) Limited, Slough (GB)

(72) Inventors: Tom Adams, Hull (GB); Alberto Buogo, Hull (GB); Samuel Guo, Dongguan (CN)

(73) Assignee: RECKITT BENCKISER (BRANDS) LIMITED, Slough (GB)

( * ) Notice: Subject to any disclaimer, the term of this patent is extended or adjusted under 35 U.S.C. 154(b) by 99 days.

(21) Appl. No.: 15/027,808

(22) PCT Filed: Oct. 9, 2014

(86) PCT No.: PCT/GB2014/053038

§ 371 (c)(1),
(2) Date: Apr. 7, 2016

(87) PCT Pub. No.: WO2015/052520

PCT Pub. Date: Apr. 16, 2015

(65) Prior Publication Data

US 2016/0270503 A1 Sep. 22, 2016

(30) Foreign Application Priority Data

Oct. 9, 2013 (GB) ..... 1317865.2

(51) Int. Cl.
*A45D 26/00* (2006.01)

(52) U.S. Cl.
CPC .... *A45D 26/0014* (2013.01); *A45D 2200/155* (2013.01)

(58) Field of Classification Search
CPC combination set(s) only.
See application file for complete search history.

(56) References Cited

U.S. PATENT DOCUMENTS 5,207,236 A * 5/1993 Santhouse ..... A45D 4/16 132/227
6,616,363 B1 * 9/2003 Guillaume ..... A01M 1/2061 401/1

FOREIGN PATENT DOCUMENTS

| | | | |
|---|---|---|---|
| CN | 202311825 | U | 7/2012 |
| FR | 2591446 | A1 | 6/1987 |
| GB | 2347916 | A | 9/2000 |
| WO | 2002078486 | A1 | 10/2002 |

OTHER PUBLICATIONS

International Search Report and Written Opinion in related PCT Application No. PCT/GB2014/053038 dated Dec. 8, 2014.
GB Search Report for the related GB Application No. GB1317865.2, dated Apr. 3, 2014.
International Preliminary Report on Patentability for related PCT Application No. PCT/GB2014/053038 dated Feb. 10, 2016.

* cited by examiner

*Primary Examiner* — David Walczak
(74) *Attorney, Agent, or Firm* — Troutman Sanders LLP; Ryan Schneider; Chris Davis

(57) ABSTRACT

A device for heating an epilatory wax, a unit block of a solidified epilatory wax for use with the device and a kit including the device and at least one unit block of a solidified epilatory wax.

15 Claims, 1 Drawing Sheet

HEATING DEVICE

CROSS-REFERENCE TO RELATED APPLICATIONS

This application is a US National Stage of International Application No. PCT/GB2014/053038, filed 9 Oct. 2014, which claims the benefit of GB 1317865.2, filed 9 Oct. 2013, both of which are fully incorporated by reference.

BACKGROUND OF THE INVENTION

1. Field of the Invention

The present invention relates to a wax heating apparatus and more particularly to an apparatus for heating and melting wax to be used as an epilatory means.

2. Description of Related Art

It is known to use hot wax in a semi-liquid state for epilation. The hot wax is applied to the skin in thin layers in order to maximize the effectiveness of epilation. The layers can be up to 2 mm thick. After the wax has cooled and solidified it is removed from the skin.

In order to use wax for such purposes, it must be melted and kept at a certain temperature to ensure that it is sufficiently fluid to be applied effectively yet not too hot which might result in injury to a user.

Typically the wax is kept in a container which is immersed in hot water bringing the wax to a liquid state. In such circumstances constant heating of the water at a precise temperature is required to keep the wax in a molten state. Commonly, however, control of the temperature of the wax is very difficult. Standing the container in hot or boiling water can present a hazard to a consumer as the wax will burn a user at a temperature of above ~65° C. In addition, the container becomes wet which is messy and can make it difficult to handle. Moreover, a vessel to hold the hot water may not always be readily to hand.

Heating the wax in a microwave oven is not very satisfactory from a safety point of view. Great care must be taken to ensure that the wax is not overheated. This is not always easy as microwave ovens have a tendency to cause localized hot spots in the material being heated. Furthermore, the power output and efficiency of microwave ovens can vary significantly from one to another. It will be readily understood that it is undesirable to allow the possibility of overheating in any material which is to be applied directly to the skin.

In addition, in all known heating methods it is required to wait until the whole quantity of wax is molten. However, in existing devices this can take a considerable amount of time or the wax can become overheated. In addition, there is dissatisfaction in the design of existing containers as it can be difficult to remove the molten wax therefrom.

WO 02/078486 discloses an assembly for wax depilation comprising at least a box made of a good heat conducting material, containing depilatory wax and a heating apparatus including at least a chamber for receiving said wax box, and electric heating means that are in thermal contact with the chamber wall for heating the latter and the wax box comprised therein.

Notably, WO 02/078486 does not disclose a disc of wax. Solid waxes, for example granules, are disclosed in WO 02/078486 but there is no specific reference to discs.

GB 2347916 (A) discloses a container adapted to heat and dispense material comprises a first compartment adapted, in use, to be filled with the material requiring heating, such as epilatory wax, and a second compartment adjacent to the first compartment and separated therefrom by a dividing wall.

Notably, GB 2347916 (A) refers to epilatory waxes that can be heated in the device. GB 2347916 (A) refers to different physical forms of the compositions to be heated in the devices of GB 2347916 (A). Yet, no reference is made in GB 2347916 (A) to wax discs.

FR 2591446 (A1) discloses apparatuses for preparing waxes, paraffin and other materials with a low melting point, used for removing hair, wherein the metals that are generally employed for this type of construction are replaced by high-temperature, isophthalic resins.

CN 202311825 (U) discloses a one-touch full-automatic bucket-type human body depilation wax-treat instrument.

It would be desirable to be able to use a container that is provided with integral means for facilitating warming of its contents, thereby obviating or at least mitigating the problems described hereinabove, and improving upon the exemplary art.

BRIEF SUMMARY OF THE INVENTION

According to a first aspect of the present invention there is provided a device for heating an epilatory wax, wherein the device comprises a chamber wherein the chamber is provided with an additional heating means in the form of a tower wherein the device is provided with a temperature controlling means to ensure that the wax is maintained in a molten state within a temperature of 50° C.-70° C. and further wherein the temperature controlling means is in direct contact with the metallic container which holds the wax.

The tower can be located in the center of the chamber.

The height of the tower can be up to 95% of the height of the chamber.

The tower can be circular in shape and cover about 20%-80% of the area of the chamber. The tower can cover about 40%-60% of the area of the chamber.

A channel can be formed between the tower and the wall of the chamber that has a width that is 20%-30% of the width of the chamber. The channel can be 25% of the width of the chamber.

The temperature range of the molten wax can be 60° C.–68° C.

The temperature controlling means can be positioned such that it reduces the temperature fluctuation when the target temperature is reached.

The temperature controlling means can be provided with a sensor that measures the temperature of the wax. The sensor can be in the form of a positive thermal co-efficient material (PTC material) or a negative thermal co-efficient material (NTC material). The sensor can be located at a distance such that the sensor material provides a consistent measurement of the wax.

According to a second aspect of the present invention there is provided an epilatory kit comprising a device for heating an epilatory wax as disclosed above and unit blocks of a solidified epilatory wax.

The unit blocks of wax can be in the form of discs or in the form of a pearl. The discs can have a circumference of 55 mm and a depth of 7 mm, or the pearl can have a generally hemispherical shape and a radius of 2 mm-5 mm.

The unit block of wax can comprise from 15 g-25 g of wax. The unit block of wax can comprise 20 g of wax.

In preferred embodiments, the present invention provides for a device (and a kit comprising that device) which contains a temperature controlling means in direct contact with the metallic container which holds the wax. This provides e.g. for good control of the temperature of the wax in the metal container so that the wax is kept molten throughout its volume but not a temperature at which it is too hot to apply to the skin. In particular, by having the temperature controlling means in direct contact with the metallic container temperature fluctuations when the wax has reached the target temperature can be addressed.

None of the four referenced prior art documents disclose the feature of temperature controlling means in direct contact with the metallic container which holds the wax and it is submitted that it does not suggest it either. Starting from these particular references there is no reason for the skilled person to cite the temperature controlling means as according to the present invention. Further, the noted prior art does also not in any way disclose or suggest wax discs.

According to a third aspect of the present invention there is provided an epilatory kit comprising a device for heating an epilatory wax and unit blocks of a solidified epilatory wax, wherein the device comprises a chamber which receives a solidified epilatory wax wherein the chamber is provided with an additional heating means in the form of a tower and wherein the dimensions of the tower and the unit blocks of wax are such that the solidified epilatory wax melts at a rate of between 15 s-50 s per gram.

For the avoidance of doubt the chamber and the additional heating means act together to provide heat to the unit blocks of wax.

The tower is typically located in the center of the chamber.

The tower is typically circular in shape and can cover about 20%-80% of the area of the chamber. The tower can cover about 30%-70% of the area of the chamber. The tower can cover about 40%-60% of the area of the chamber. The tower can cover about 50% of the area of the chamber.

The diameter of the tower can be from 45-55 mm.

The channel formed between the tower and the wall of the chamber can have a width that is 20-30% of the width of the chamber. Typically the diameter is 25% of the width of the chamber.

The unit blocks of wax can be in the form of discs. The discs typically have a circumference of 55 mm and a depth of 7 mm. The individual blocks of wax can comprise from 15 g-25 g of wax, and typically can comprise 20 g of wax.

Alternatively, the unit block of wax can be in the form of pearls. Typically, the pearls will have a generally hemispherical shape and have a radius of 2 mm-5 mm.

The device is typically provided with a temperature controlling means to ensure that the wax is maintained in a molten state within a temperature of 50° C.-70° C. Preferably the temperature range of the molten wax is 60° C.-68° C.

The temperature controlling means is typically in the form of at least one positive thermal co-efficient element (PTC element). In a preferred embodiment there are two PTC elements.

The temperature controlling means is in direct contact with the metallic container which holds the wax. The temperature controlling means is positioned such that it reduces the temperature fluctuation when the target temperature is reached.

The temperature controlling means is provided with a sensor which measures the temperature of the wax. The sensor can be in the form of a positive thermal co-efficient material (PTC material). Alternatively, the sensor can be in the form of a negative thermal co-efficient material (NTC material). The sensor is located at a distance such that the sensor material provides a consistent measurement of the wax. The sensor is typically located adjacent to the tower. The sensor is typically located between 1 cm and 5 cm from the temperature controlling means. In a preferred embodiment the sensor is located between 3 cm and 3.5 cm from the temperature controlling means.

According to a fourth aspect of the present invention there is provided a device for heating an epilatory wax, wherein the device comprises a chamber wherein the chamber is provided with an additional heating means in the form of a tower.

The tower is typically located in the center of the chamber.

The height of the tower is typically up to 95% of the height of the chamber. The height of the tower can be from 50 mm-60 mm.

The tower is typically circular in shape and can cover about 20%-80% of the area of the chamber. The tower can cover about 30%-70% of the area of the chamber. The tower can cover about 40%-60% of the area of the chamber. The tower can cover about 50% of the area of the chamber.

The diameter of the tower can be from 45 mm-55 mm.

The channel formed between the tower and the wall of the chamber can have a width that is 20%-30% of the width of the chamber. Typically the channel is 25% of the width of the chamber.

The device is typically provided with a temperature controlling means to ensure that the wax is maintained in a molten state within a temperature of 50° C.-70° C. Preferably the temperature range of the molten wax is 60° C.-68° C.

The temperature controlling means is typically in the form of at least one positive thermal co-efficient element (PTC element). In a preferred embodiment there are two PTC elements.

The temperature controlling means is in direct contact with the metallic container which holds the wax. The temperature controlling means is positioned such that it reduces the temperature fluctuation when the target temperature is reached.

The temperature controlling means is provided with a sensor which measures the temperature of the wax. The sensor can be in the form of a positive thermal co-efficient material (PTC material). Alternatively, the sensor can be in the form of a negative thermal co-efficient material (NTC material). The sensor is located at a distance such that the sensor material provides a consistent measurement of the wax. The sensor is typically located adjacent to the tower. The sensor is typically located between 1 cm and 5 cm from the temperature controlling means. In a preferred embodiment the sensor is located between 3 cm and 3.5 cm from the temperature controlling means.

According to a fifth aspect of the present invention there is provided a unit block of wax intended for use in the kit of the first aspect of the present invention or the device of the second aspect of the present invention.

The unit block of wax can be in the form of a disc. The disc typically has a circumference of 55 mm and a depth of 7 mm.

Alternatively, the unit block of wax can be in the form of pearls. Typically, the pearls will have a generally hemispherical shape and have a radius of 2 mm-5 mm.

Each individual block of wax can comprise from 15 g-25 g of wax, and typically can comprise 20 g of wax.

These and other objects, features and advantages of the present invention will become more apparent upon reading the following specification in conjunction with the accompanying drawing figures.

BRIEF DESCRIPTION OF THE DRAWINGS

An embodiment of the present invention will now be described, by way of example only, with reference to the accompanying drawings in which.

DETAIL DESCRIPTION OF THE INVENTION

Figure 1:
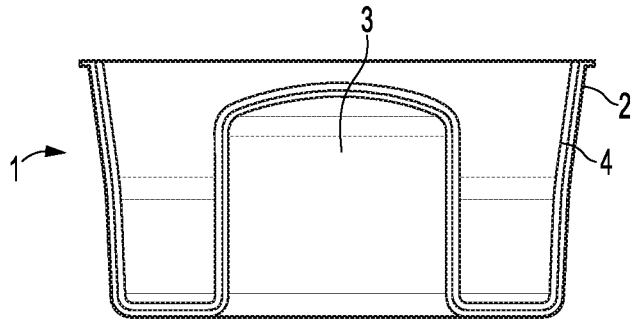
FIG. 1 illustrates a side view of a device in accordance with the present invention.
Figure 2:
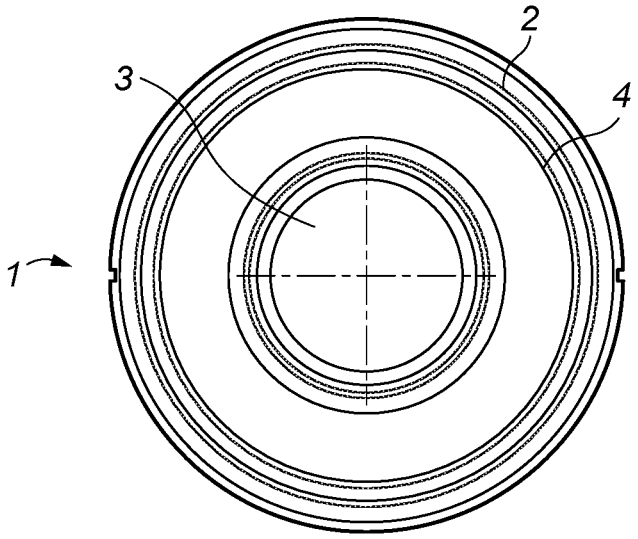
FIG. 2 illustrates a view from above of a device in accordance with the present invention.
Figure 3:
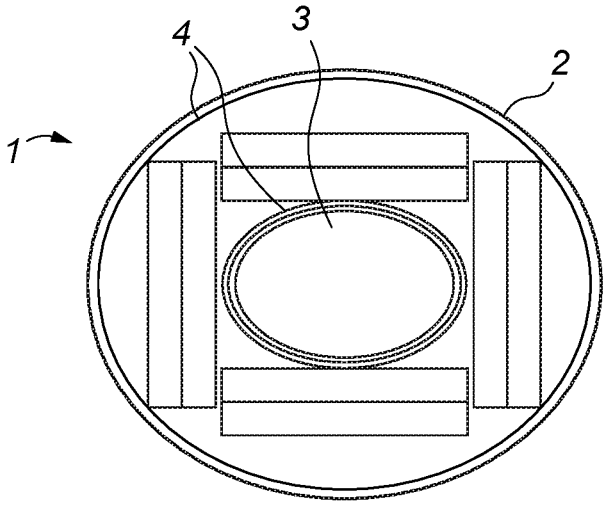
FIG. 3 illustrates the device of the present invention containing wax discs prior to the application of heat.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

Referring to the Figures, a device in accordance with the present invention is generally shown at 1. The device comprises body 2 in which is placed the solid wax discs. The body is provided with a central tower 3 which also serves to heat the wax. The body is provided with a heating mechanism (not shown). The chamber 4 is configured to receive at least one unit block of the solid wax further contained in the body 2, and the chamber is provided with an additional heating element in the form of a tower 3.

Once the wax has reached its temperature of use and has softened, a spatula can be used to apply the wax to a user's skin.

The heat generated by the conductive element is absorbed by the wax which increases its temperature up to an optimal value at which the viscosity of the wax is ideal for spreading the wax through the applicator over the skin and the temperature is not too high to be harmful or to cause discomfort when the wax gets in contact with the skin.

The heat generated by the heating element is controlled by the electrical properties of the material of the heating element which has a positive temperature resistance: PTC heating element. The PTC heating element increases its electrical resistance with the temperature, this has the effect of decreasing the power generated by the heating element and the heat transferred to the wax. The heating behavior of the PTC is such to limit the temperature of the wax to its optimal dispensing temperature. In the device of the present invention the PTC heating element initially provides a power of about 600 W. After a short period, typically of about 500 ms, the power drops to about 50 W. Subsequently after a few minutes, the power drops to between 25 W and 30 W. The minimum power produced by the PTC heating element is between 15 W and 20 W.

A sensor is attached to the bottom of the aluminum pot, and is connected to the PTCs. When the sensor senses a temperature >65° C. (upper limit) it powers off the PTC. Once the PTCs are not powered the temperature of the whole system decrease. When the sensor senses a temperature <60° C. (lower limit) it powers on the PTCs.

If the sensor is located too close to the heating element (PTC) it measures only the temperature of the PTC, which is not the same as the temperature of the wax as the area around the PTC is hotter than the rest of the system. Placing the sensor at a certain distance from the PTC ensures a temperature reading which is more representative of the whole wax content.

Further modifications and improvements can be made without departing from the scope of the invention described herein. Numerous characteristics and advantages have been set forth in the foregoing description, together with details of structure and function. While the invention has been disclosed in several forms, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

The invention claimed is:

1. A device for heating unit blocks of epilatory wax comprising:

a chamber configured to receive at least one unit block of the solidified epilatory wax, wherein the chamber is provided with an additional heating element in the form of a tower; and a temperature controlling element configured to maintain wax in a molten state within a temperature range of approximately 50° C.-70° C.;

wherein the temperature controlling element is configured to be in direct contact with a metallic container which holds the wax;

wherein the tower covers about 40%-60% of the area of the chamber; and wherein the chamber and the additional heating element act together to provide heat to the unit blocks of epilatory wax.

2. The device as claimed in claim 1, wherein the tower is located in the center of the chamber.

3. The device as claimed in claim 1, wherein the height of the tower is up to approximately 95% of the height of the chamber.

4. The device as claimed in claim 1, wherein a channel formed between the tower and a wall of the chamber has a width that is from approximately 20%-30% of the width of the chamber.

5. The device as claimed in claim 1, wherein the temperature controlling element is configured to maintain wax in a molten state within a temperature range of approximately 60° C.-68° C.

6. The device as claimed in claim 1, wherein the temperature controlling element is provided with a sensor that measures the temperature of the wax.

7. The device as claimed in claim 6, wherein the sensor comprises a material selected from the group consisting of a positive thermal co-efficient material (PTC material) and a negative thermal co-efficient material (NTC material).

8. An epilatory kit comprising:

the device for heating an epilatory wax according to claim 1; and unit blocks of a solidified epilatory wax.

9. The kit as claimed in claim 8, wherein each unit block of wax is in a form selected from the group consisting of a disc and a pearl.

10. The kit as claimed in claim 8, wherein each unit block of wax is in the form of a disc having a circumference of approximately 55 mm and a depth of approximately 7 mm.

11. The kit as claimed in claim 8, wherein each unit block of wax is in the form of a pearl having a generally hemispherical shape and a radius in the range of approximately 2 mm-5 mm.

12. A unit block of a solidified epilatory wax for use in the device of claim 1, wherein the unit block of a solidified epilatory wax is in the form of a disc.

13. The unit block of a solidified epilatory wax of claim 12, wherein the disc has a circumference of approximately 55 mm and a depth of approximately 7 mm.

14. The unit block of a solidified epilatory wax of claim 12, wherein the disc comprises a range of approximately 15 g-25 g of wax.

15. The unit block of a solidified epilatory wax of claim 12, wherein the disc comprises approximately 20 g of wax.

* * * * *